United States Patent [19]

Kodama et al.

[11] 4,415,192

[45] Nov. 15, 1983

[54] DOOR LOCKING KNOB FOR VEHICLE

[75] Inventors: Yutaka Kodama, Yokosuka; Masakazu Miyoshi, Yokohama, both of Japan

[73] Assignees: Nissan Motor Co. Ltd.; Kato Hatsujo Kaisha, Ltd., both of Yokohama, Japan

[21] Appl. No.: 246,631

[22] Filed: Mar. 23, 1981

[51] Int. Cl.[3] ..... E05C 13/02

[52] U.S. Cl. ..... 292/347; 292/1; 292/336.3

[58] Field of Search ..... 411/47; 292/347, 336.3, 292/1; 403/348, 383, 343

[56] References Cited

U.S. PATENT DOCUMENTS

| | | | |
|---|---|---|---|
| 858,897 | 7/1907 | McMillen | 411/417 X |
| 1,987,474 | 1/1935 | Grant | 411/417 |
| 3,247,691 | 4/1966 | Martin | 292/1 X |
| 4,183,569 | 1/1980 | Landfried et al. | 292/347 |

*Primary Examiner*—Richard E. Moore
*Attorney, Agent, or Firm*—George B. Oujevolk

[57] ABSTRACT

A door locking knob which has a knob body including an engaging hole perforated in non-circular cross section, and a rod for insertion into the hole and including cutout surfaces formed therealong and engaging portions at the ends for securely engaging the knob body upon turning of the knob. The knob body has a leg portion, and a pair of guide grooves formed axially on both side surfaces of the leg portion. When the rod is inserted into the engaging hole of the knob body and is turned at 90° to engage the rod with the flat inside surfaces of the engaging hole of the knob body to securely implant the rod at the engaging portions into the side surfaces of the engaging holes of the knob body, so as to eliminate the necessity of internally cutting screw threads in the knob body, mounting of the door locking knob is simplified.

1 Claim, 7 Drawing Figures

DOOR LOCKING KNOB FOR VEHICLE

BACKGROUND OF THE INVENTION

This invention relates to a door locking knob for a vehicle and, more particularly, to an improvement in a door locking knob for preventing the door for the vehicle from opening while the vehicle is running.

In a door of a conventional vehicle of this type, a knob b for locking the door or releasing the door operable is, as shown in FIG. 1, arranged at one end $a_1$ of the upper portion a of a trim. When the knob b is pulled upwardly by fingers, the door A becomes in an openable state via an inside and an outside handles (not shown). When the knob b is pushed downwardly by the fingers, the door A is retained in a locked state even if the inside or the outside handle is actuated.

On the one hand, the locking knob of this type was formed heretofore, for example, of synthetic resin material, and a screw thread cutting means for molding screw threads by engaging a rotating screw thread die was employed to form female screw threads over the peripheral surface of the locking knob from the head to the leg.

More particularly, since the threaded hole is perforated at the central hole of the knob body, for example, by a tap or the like, the knob not only necessitates a mold having a complicated structure, but also requires an intricate assembling work. Furthermore, it is difficult to save labor in the mass production of such locking knobs so as to provide the knobs inexpensively.

On the other hand, in the assembling work of a vehicle, the locking knob has disadvantages such that knobs for different types of vehicles have different sizes and assembling dimensions depending upon the type of the vehicle to thereby require a variety of types of knobs having different thread size, and that the length of the threaded portion thereof is adjusted by the regulation of the screwing of the screw threads to thereby require complicated adjustment and assembling of the threaded portion of the knob.

OBJECTS OF THE INVENTION

Accordingly, an object of this invention is to provide a door locking knob for a vehicle which eliminates the aforementioned disadvantages of the conventional locking knob.

Another object of this invention is to provide a door locking knob for a vehicle which eliminates the necessity of cutting screw threads in the interior of the knob body.

Yet another object of this invention is to provide a door locking knob for a vehicle which can simplify the number of forming the knob.

A further object of this invention is to provide a door locking knob for a vehicle which can be used for the type having different size of screw threads.

Still another object of this invention is to provide a door locking knob for a vehicle which can be easily assembled.

Still another object of the invention is to provide a door locking knob for a vehicle which can be adapted for mass production due to labor-saving in the fabrication of the knob.

SUMMARY OF THE INVENTION

In order to eliminate the aforementioned disadvantages of the conventional door locking knob, there is provided according to this invention a door locking knob which has a knob body including an engaging hole perforated in a central axis direction in a non-circular shape cross section such as in a curvilinear shape or elliptical cross section, and a rod inserted into the hole and including cutout surfaces formed therealong and engaging portions such as threaded portions of teeth shape or sawtooth shape in cross section at the ends for securely engaging the knob body upon turning of the knob.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
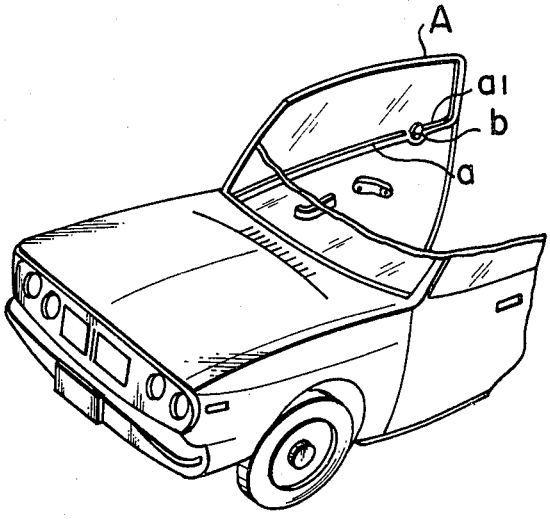
FIG. 1 is a perspective view of a door for a vehicle for the explanatory purpose of the example of a locking knob in use.
Figure 2:
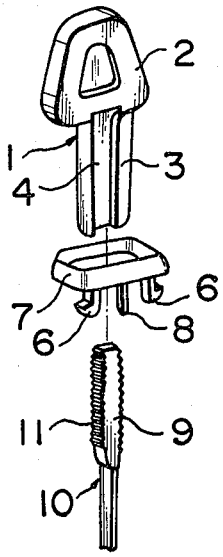
FIG. 2 is an exploded perspective view of the door locking knob as one preferred embodiment constructed according to this invention.
Figure 3:
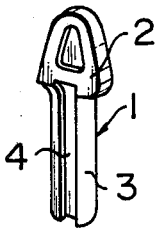
FIG. 3 is a perspective view of the knob body used in the door locking knob of this invention.
Figure 4:
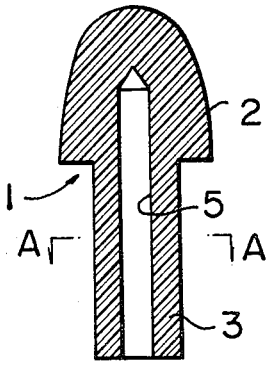
FIG. 4 is an enlarged sectional view of the knob body.
Figure 5:
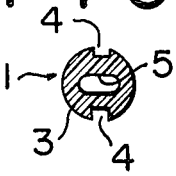
FIG. 5 is a cross sectional view of the knob body taken along the lines A—A in FIG. 4.

Referring now to the drawings, particularly to FIGS. 2 through 7, showing one preferred embodiment of the door locking knob constructed according to this invention, wherein like reference numerals designate the same parts in the respective views, a knob body, generally designated by reference numeral 1, is formed to have a leg portion 3 and a head grip portion 2 integrally molded with the leg portion 3. The knob body 1 further has a pair of guide grooves 4 formed axially on both side surfaces of the leg portion 3 thereof, and an engaging hole 5 perforated at the central axial portion thereof in long circular cross section. A fixing member 7 having a pair of engaging pawls 6 is loosely engaged with the leg portion 3 of the knob body 1, and guide keys 8 are loosely engaging with the guide grooves 4 of the knob body 1 at the central portion of the fixing member 7.

The respective engaging pawls 6 of the fixing member 7 are fixedly secured by engaging them with the engaging hole perforated at the upper portion of the trim of the door for a vehicle at the time of assembling itself.

Figure 6:
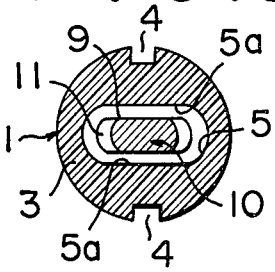
FIGS. 6 and 7 are views for the explanatory purpose of the operation of the door locking knob of this invention.
Figure 7:
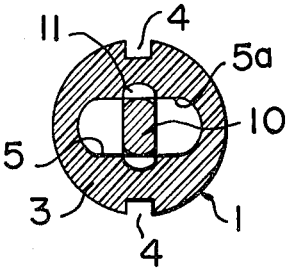

On the other hand, the knob further has a rod 10 including cutout surfaces 9 and 9 and engaging portions 11 of threaded tooth shape. When the rod 10 is inserted into the engaging hole 5 of the knob body 1 and is then turned substantially at 90°, the rod 10 is engaged at the engaging portions 11 with the inside surfaces of the engaging hole 5 of the knob body 1 in such a manner as to be implanted into the surfaces of the holes 5. More particularly, since the rod 10 is so formed as to have two cutout portions 9 and 9 on the outer periphery of the engaging portions 11, the rod 10 is loosely engaged with the engaging hole 5 of the knob body 1 in case that the cutout surfaces 9 and 9 of the rod 10 confront the flat inside surfaces 5*a* of the engaging hole 5 of the knob body 1, while the rod 10 is securely engaged with the engaging hole 5 of the knob body 1 by engaging and implanting the outer peripheral edges of the engaging portions 11 of the rod with and into the flat inside surfaces 5*a* of the engaging hole 5 of the knob body 1 in case the rod 10 is turned substantially at 90° with respect to the engaging hole 5 of the knob body 1, as shown in FIGS. 6 and 7.

Accordingly, when a vehicle is assembled, a door wind regulator and the like are already associated with the vehicle, a trim is further mounted thereat in a completely assembled state, and the rod 10 is so inserted at the engaging portions 11 in the state slightly exposed externally with respect to the predetermined assembling position of the locking knob constructed according to this invention. This is done to eliminate the erroneous assembling of the knob body at the time of assembling irrespective of the sequence of assembling components and type of the vehicle body, though the height thereof is not always constant.

When assembling the knob body 1, the leg portion 3 of the knob body 1 is engaged beforehand with the fixing member 7 along the guide keys 8, the engaging hole 5 of the knob body 1 is introduced along the cutout surfaces 9 and 9 of the rod 10, and the rod 10 is then turned substantially at 90° relatively with respect to the engaging hole 5 of the knob body 1 as was described previously so as to tightly engage the rod 10 at the engaging portions 11 with the engaging hole 5 of the knob body 1. That is, when the knob body 1 is turned substantially at 90°, the head grip 3 of the knob body 1 is disposed in parallel with the door side surface for the vehicle.

It is noted that although the engaging hole 5 of the knob body 1 of the door locking knob in this embodiment of this invention was described with reference to the long circular shape cross section, the engaging hole 5 of the knob body 1 may also employ freely, for example, an elliptical cross section, rectangular shape cross section and the like within the spirits of the scope of this invention. It is also noted that the knob body 1 is desired to be formed of synthetic resin being relatively soft and elastic such as, for example, polypropylene. It is further noted that the two cutout surfaces 9 and 9 of the rod 10 may be freely reduced to only one cutout surfaces as required.

It should be understood from the foregoing description that since the door locking knob of this invention has the knob body 1 including an engaging hole 5 of non-circular cross section perforated along the central axis direction thereof and the rod 10 including the engaging portions and cutout surfaces 9 formed thereon so that the rod 10 is inserted into the engaging hole 5 of the knob body and is turned at 90° to engage the rod 10 with the flat inside surfaces of the engaging hole 5 of the knob body 1 to securely implant the engaging portions of the rod 10 into the side surfaces of the engaging holes of the knob body, it can eliminate the necessity of internally cutting screw threads in the knob body 1, further simplify the steps of forming the knob, and yet easily assemble the knob in mass production inexpensively.

What is claimed is:

1. A door locking knob arrangement including a head grip (2) with a vertically extending narrow part, said head grip being for a motor vehicle to prevent the vehicle door from opening when said head grip (2) is pushed down, said door locking arrangement being placed in a vehicle door trim and connected to a vehicle door lock, said door locking knob arrangement comprising in combination:

(a) an elongated knob body (1) integral with and extending from said head grip (2) including a leg portion (3) with an outer end, having an engaging hole (5) extending from said outer end through said leg portion (3) to the head grip (2), said engaging hole (5) being slit-shaped in cross-section, and, a pair of guide grooves (4), defined axially on both sides of said leg portion (3);

(b) a rod (10) with sides, said rod being disposed to be connected at one end portion of said rod to a door lock and having at least one engaging portion at the other end portion, said engaging portion extending along one side of said rod, and, at least one flat surface (9) extending axially along the other side substantially parallel to the engaging portion, said rod being so disposed as to enter said engaging hole (5); and, (c) a fixing member (7) having a rectangular aperture therein, said fixing member having a pair of engaging pawls (6) loosely engaged with said leg portion (3) and guide keys (8) loosely engaged with guide grooves (4), said engaging pawls (6) also securing said knob body (1) to the upper portion of an automobile trim;

whereby, after said rod (10) is placed in the vehicle trim, said knob body (1) is inserted over said rod (10) through the aperture of said fixing member (7) along at least one flat surface (9) and then the head grip (2) together with the knob body (1) and the rod are turned 90° with respect to each other thus securing the head grip and knob body to the rod as the engaging portion of the rod engages the wall of said engaging hole.

* * * * *